United States Patent [19]

Naruse et al.

[11] Patent Number: 5,024,924

[45] Date of Patent: Jun. 18, 1991

[54] METHOD FOR PROCESSING SILVER HALIDE COLOR PHOTOGRAPHIC MATERIALS

[75] Inventors: Hideaki Naruse; Osamu Takahashi; Nobutaka Ohki; Michio Ono, all of Kanagawa, Japan

[73] Assignee: Fuji Photo Film Co., Ltd., Kanagawa, Japan

[21] Appl. No.: 427,381

[22] Filed: Oct. 27, 1989

[30] Foreign Application Priority Data

Oct. 28, 1988 [JP] Japan ..... 63-272131

[51] Int. Cl.[5] ..... G03C 7/00

[52] U.S. Cl. ..... 430/376; 430/399; 430/551

[58] Field of Search ..... 430/376, 399, 551

[56] References Cited

U.S. PATENT DOCUMENTS

| | | | |
|---|---|---|---|
| 4,631,252 | 12/1986 | Howell | 430/551 |
| 4,797,351 | 1/1989 | Ishikawa et al. | 430/387 |
| 4,820,623 | 4/1989 | Koshimizu et al. | 430/376 |
| 4,863,840 | 9/1989 | Komorita et al. | 430/505 |

FOREIGN PATENT DOCUMENTS 56-21145 5/1981 Japan .

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A method for continuously processing a silver halide color photographic material comprising a support having thereon at least one silver halide emulsion layer with a color developing bath which contains at least one primary aromatic amine color developing agent, wherein at least one compound represented by formular (I) is present in said silver halide emulsion layer in an amount of from 3 to 10 mol % per mol of coupler in the layer in which the compound is added, and said silver halide color photographic material is processed with said color developing bath where the replenishment rate is from 20 ml to 200 ml per square meter of the silver halide color photographic material processed (I)

wherein $R^1$, $R^2$, $R^3$, $R^4$, $R^5$ and $R^6$, which may be the same or different, each represents a hydrogen atom, a halogen atom, a sulfo group, a carboxyl group, a cyano group, an alkyl group, an aryl group, an acyl group, an amino group, a sulfonamide group, an alkoxy group, an aryloxy group, an alkylthio group, an arylthio group, an acyl group, an acyloxy group, a carbamoyl group, an alkoxycarbonyl group or a sulfamoyl group, and $R^1$ and $R^2$, and $R^4$ and $R^5$, may together form a carbocyclic ring or a heterocyclic ring; and Z represents a single bond or a divalent organic group.

3 Claims, No Drawings

METHOD FOR PROCESSING SILVER HALIDE COLOR PHOTOGRAPHIC MATERIALS

FIELD OF THE INVENTION

The present invention concerns a method for processing silver halide color photographic materials and, more precisely, it concerns a method for processing in which dye images having excellent gradation can be obtained using continuous processing with a very low replenishment rate of a color developing bath and without any adverse effect on the photographic properties.

BACKGROUND OF THE INVENTION

The processing of silver halide color photographic materials consists primarily of two processes, namely color development (with prior black-and-white development in the case of a color reversal material) and a desilvering process. The desilvering process can be carried out using a bleaching process and a fixing process, or a single bath bleach-fixing process may be carried out together or separately. Additional processes, such as water washing processes, stopping processes, stabilizing processes and preceding processes for accelerating development, for example, can also be included, if desired.

In color development, the exposed silver halide is reduced to form silver and, at the same time, couplers react with the oxidized primary aromatic amine developing agent to form dyes. The halide ions which are produced by the breakdown of the silver halide in this process are dissolved in and accumulated in the developing bath. On the other hand, the color developing agents are consumed by the reaction with the couplers mentioned above. Other components are also lost by retention in the photographic photosensitive material and the component concentration in the developing bath falls. Hence, in the continuous processing of a large amount of a silver halide photographic material in an automatic processor, for example, some means of maintaining the components of the color developing bath at fixed concentrations are required to prevent a variation in the development characteristics due to changes in the developing bath component concentrations.

For example, as the effect of concentration in the consumed components such as developing agents and preservatives is slight, the concentration in the replenisher is generally increased. Furthermore, there are cases in which dissolved out materials which have the effect of inhibiting development, such as halides, are included in low concentrations in the replenisher or omitted from the replenisher altogether. Moreover, compounds which have the effect of eliminating the effect of the dissolved out components have also been included in the replenishers. Furthermore, there are also cases in which the pH and the concentrations of alkali and of chelating agents, etc., are adjusted. Normally, methods of replenishment with a replenisher are used to replenish the deficient components and to dilute the components of which the concentrations increase. A large amount of overflow is created naturally by replenishment with a replenisher and this causes problems both economically and from the point of view of pollution.

Recently, reduction in the replenishment rate (i.e., the amount of replenisher) of color developers has become very desirable with the increased processing rates now being used to conserve resources and to reduce pollution levels. However, if the replenishment rate of the color developing bath is simply reduced, the problems arise because of the adverse effects on photographic properties due to the dissolving out and accumulation of the materials which are dissolved out from the photosensitive materials. This problem is especially pronounced with the hydroquinone based compounds which are included in photosensitive materials as gradation controlling agents.

Methods of increasing the oil solubility of the hydroquinone based compounds have been considered as a means of overcoming this problem. However, although there is some improvement in the changes in photographic properties on running when these hydroquinone based compounds are used, they do not have a satisfactory effect as gradation controlling agents and good photographic properties are not obtained. Furthermore, a method in which dimers of these hydroquinones are included in photosensitive materials is disclosed in JP-B-56-21145 (the term "JP-B" as used herein refers to an "examined Japanese patent publication"). However, in this disclosure, the processing involved is a low temperature processing (25° C.) and the effect is different from that of the present invention in that the compounds are included to prevent the occurrence of color turbidity. Thus, the gradation controlling effect in the low replenishment processing of the present invention could not be readily predicted on the basis of this prior art.

In this sense, the development of a technique for achieving good gradation without washing out into the developing bath during continuous processing and without adverse effect on the photographic properties is clearly desirable.

SUMMARY OF THE INVENTION

Hence, an object of the present invention is to provide a method for development processing in which, even in rapid, continuous processing in which the replenishment rate of the developing bath is greatly reduced, variation in photographic properties, and especially in maximum density, minimum density and gradation, is slight, and good gradation can be achieved in a stable manner.

The above-described object of the present invention has been achieved using the method outlined below.

The object of the present invention has been achieved by a method for continuously processing a silver halide color photographic material comprising a support having thereon at least one silver halide emulsion layer with a color developing bath which contains at least one primary aromatic amine color developing agent, wherein at least one compound represented by formula (I) is present in the silver halide emulsion layer in an amount of from 3 to 10 mol % per mol of coupler in the layer in which the compound is added and the silver halide color photographic material is processed with the color developing bath where the replenishment rate is from 20 ml to 200 ml per square meter of the silver halide color photographic material

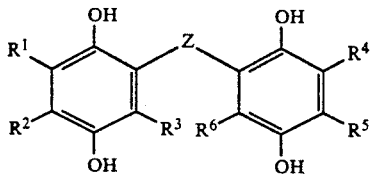

(I)

wherein $R^1$, $R^2$, $R^3$, $R^4$, $R^5$ and $R^6$, which may be the same or different, each represents a hydrogen atom, a halogen atom, a sulfo group, a carboxyl group, a cyano group, an alkyl group, an aryl group, an acyl group, an amino group, a sulfonamide group, an alkoxy group, an aryloxy group, an alkylthio group, an arylthio group, an acyl group, an acyloxy group, a carbamoyl group, an alkoxycarbonyl group or a sulfamoyl group, and $R^1$ and $R^2$, and $R^4$ and $R^5$, may together form a carbocyclic ring or a heterocyclic ring; and Z represents a single bond or a divalent organic group.

DETAILED DESCRIPTION OF THE INVENTION

In the formula (I), $R^1$, $R^2$, $R^3$, $R^4$, $R^5$ and $R^6$ each represents hydrogen atoms, halogen atoms (for example, chlorine, bromine, fluorine), sulfo groups, carboxyl groups, cyano groups, alkyl groups (which preferably have from 1 to 30 carbon atoms, for example, methyl, tert-butyl, cyclohexyl, tert-octyl, hexadecyl, benzyl, allyl), aryl groups (which preferably have from 6 to 30 carbon atoms, for example, phenyl, p-tolyl), acylamino groups (which preferably have from 2 to 30 carbon atoms, for example, acetylamino, benzoylamino), sulfonamide groups (which preferably have from 1 to 30 carbon atoms, for example, methanesulfonamide, benzenesulfonamide), alkoxy groups (which preferably have from 1 to 30 carbon atoms, for example, methoxy, butoxy, benzyloxy, dodecyloxy), aryloxy groups (which preferably have from 6 to 30 carbon atoms, for example, phenoxy, p-methoxyphenoxy), alkylthio groups (which preferably have from 1 to 30 carbon atoms, for example, butylthio, decylthio), arylthio groups (which preferably have from 6 to 30 carbon atoms, for example, phenylthio, p-hexyloxyphenylthio), acyl groups (which preferably have from 2 to 30 carbon atoms, for example, acetyl, benzoyl, hexanoyl), acyloxy groups (which preferably have from 1 to 30 carbon atoms, for example, acetyloxy, benzoyloxy), sulfonyl groups (which preferably have from 1 to 30 carbon atoms, for example, methanesulfonyl, benzenesulfonyl), carbamoyl groups (which preferably have from 1 to 30 carbon atoms, for example, N,N-diethylcarbamoyl, N-phenylcarbamoyl), alkoxycarbonyl groups (which preferably have from 2 to 30 carbon atoms, for example, methoxycarbonyl, butoxycarbonyl), or sulfamoyl groups (which preferably have from 0 to 30 carbon atoms, for example, N,N-dipropylsulfamoyl, N-phenylsulfamoyl) and, moreover, $R^1$ and $R^2$, and $R^4$ and $R^5$ may together form carbocyclic rings or heterocyclic rings. Z represents a single bond or a divalent organic group (which preferably has from 1 to 60 carbon atoms, for example, methylene, ethylene,

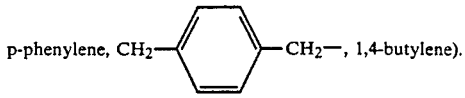

p-phenylene, $CH_2$—, 1,4-butylene).

$R^1$ to $R^6$ and Z in the formula (I) may be further substituted with alkyl groups, aryl groups, alkoxy groups, aryloxy groups, sulfo groups, carboxyl groups, amide groups, carbamoyl groups, halogen atoms and other generally known substituents.

The compounds of the formula (I) may take the form of dimers (tetramers with respect to the hydroquinone moiety).

Among compounds of the formula (I), compounds represented by formula (II) indicated below are especially preferred in the present invention.

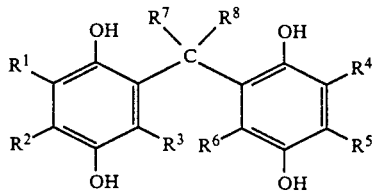

(II)

wherein $R^1$ to $R^6$ each represents groups which have the same meaning as in formular (I); $R^7$ and $R^8$, which may be the same or different, each represents hydrogen atoms, substituted or unsubstituted alkyl groups (which preferably have from 1 to 30 carbon atoms, for example, methyl, isopropyl, undecyl, benzyl), aryl groups (which preferably have from 6 to 30 carbon atoms, for example, phenyl, p-tolyl), or heterocyclic groups (which preferably have from 1 to 30 carbon atoms, for example, pyridin-2-yl), and $R^7$ and $R^8$ may together form a carbocyclic ring or a heterocyclic ring.

In the formulare (I) and (II), $R^1$ to $R^6$ preferably represent hydrogen atoms, halogen atoms, alkyl groups, aryl groups, acylamino groups or alkylthio groups, more preferably, they represent hydrogen atoms, alkyl groups, acylamino groups or alkylthio groups and, most preferably, they represent hydrogen atoms or alkyl groups.

$R^7$ and $R^8$ in the formular (II) preferably represent hydrogen atoms or alkyl groups, and those cases in which $R^7$ and $R^8$ together form a carbocyclic ring are also preferred. Compounds where $R^7$ represents a hydrogen atom and $R^8$ represents a hydrogen atom or an alkyl group are more preferred and, most preferably $R^7$ represents a hydrogen atom and $R^8$ represents methyl, ethyl, or n-propyl.

Specific examples of compounds represented by formula (I) are shown below, but the present invention is not to be construed as being limited to these examples.

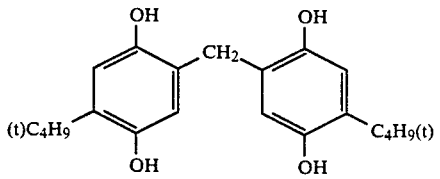

(1)

-continued
(2)
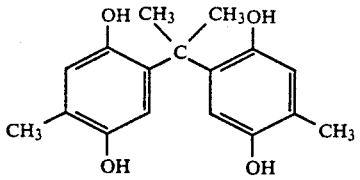
(3)
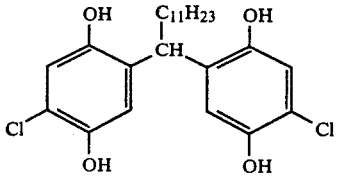
(4)
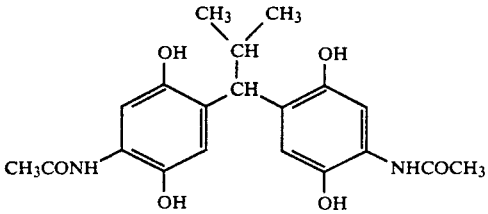
(5)
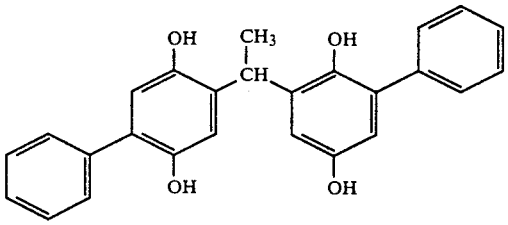
(6)
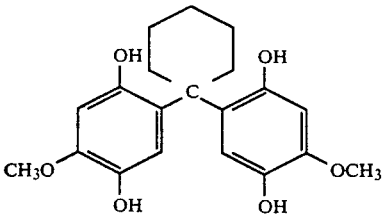
(7)
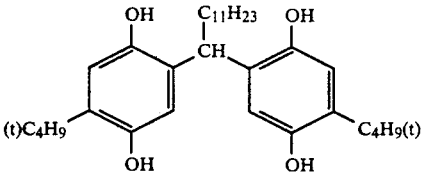
(8)
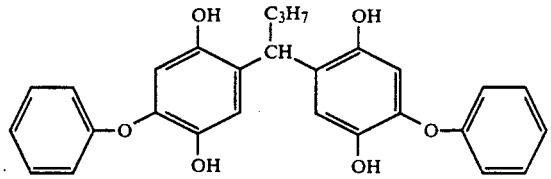
(9)
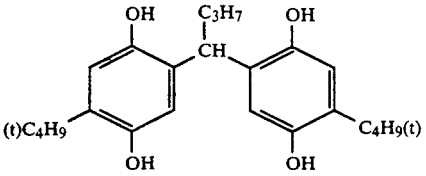

-continued
(10)
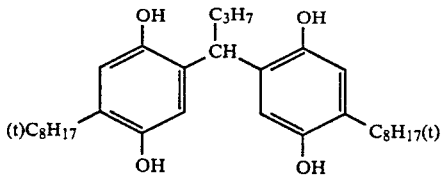
(11)
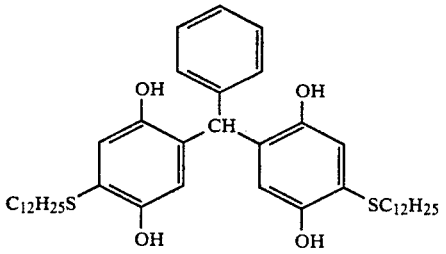
(12)
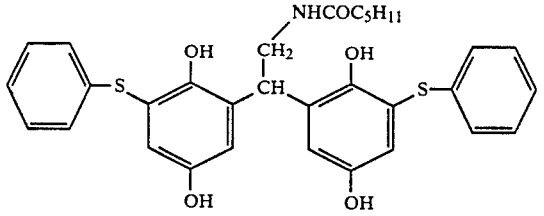
(13)
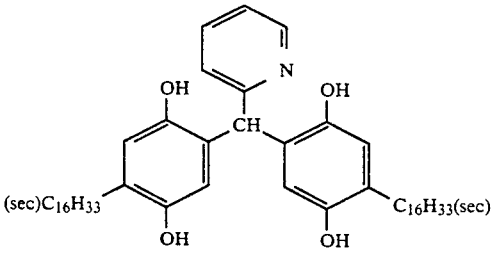
(14)
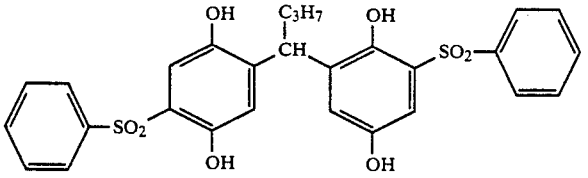
(15)
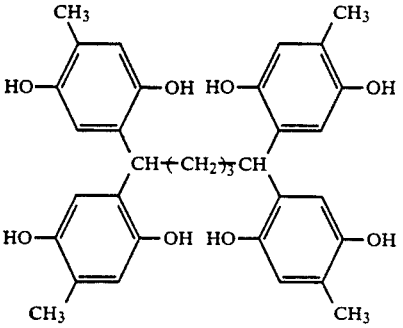

-continued
(16)
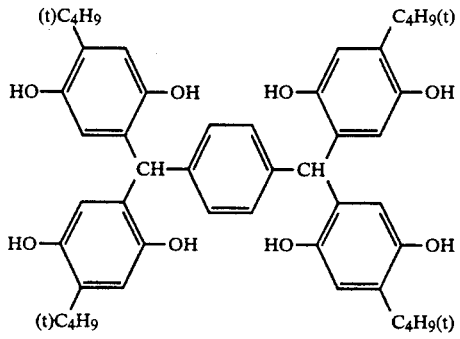
(17)
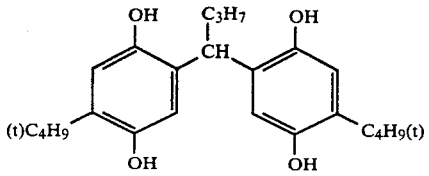
(18)
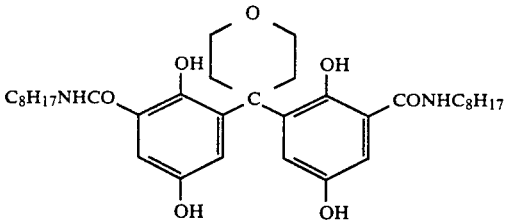
(19)
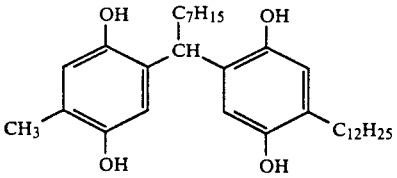
(20)
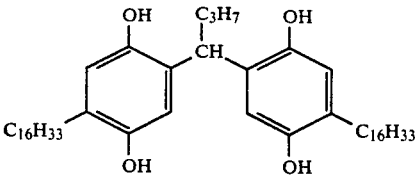
(21)
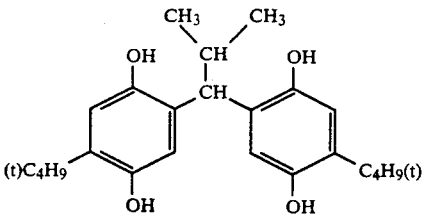
(22)
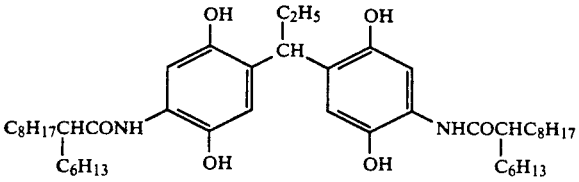

-continued
(23)
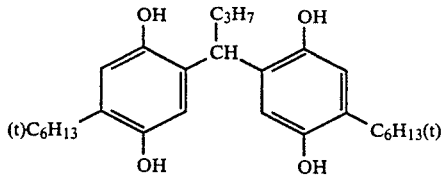
(24)
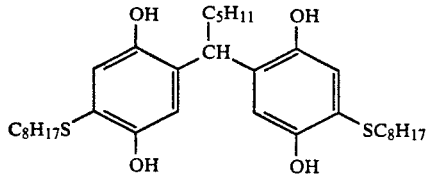
(25)
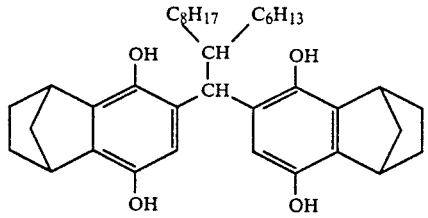
(26)
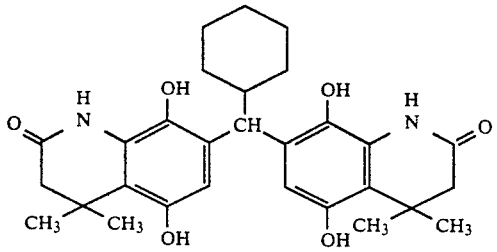
(27)
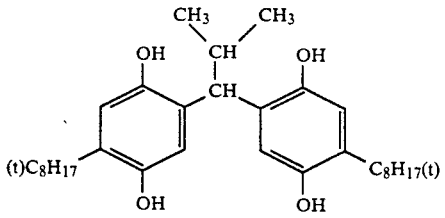
(28)
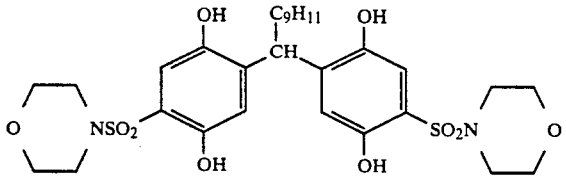
(29)
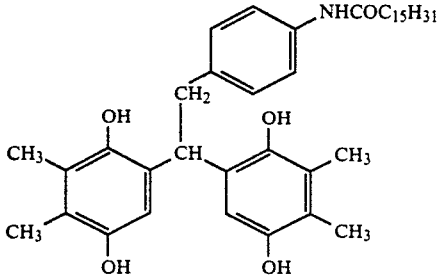

-continued
(30)
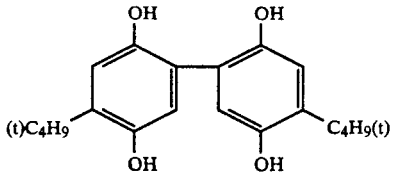
(31)
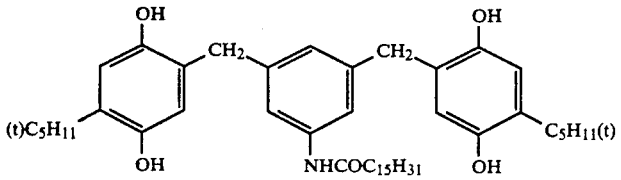
(32)
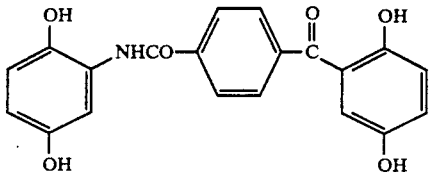
(33)
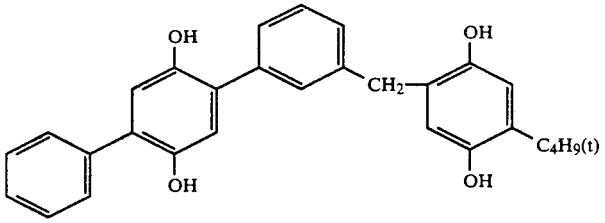
(34)
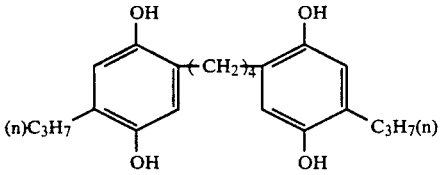
(35)
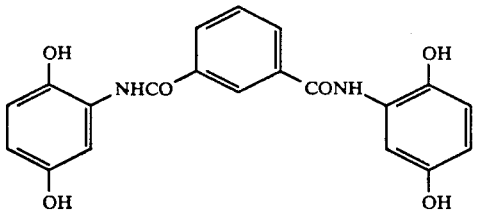
(36)
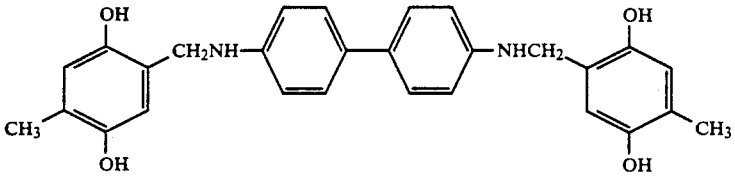
(37)
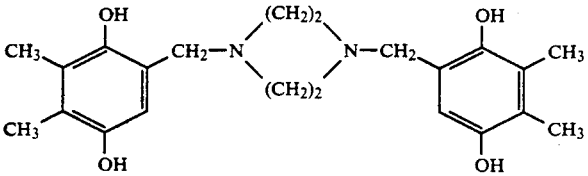

-continued

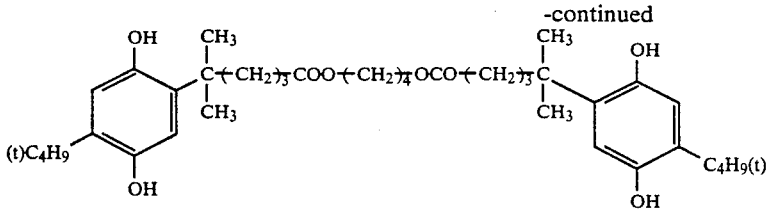

(38)

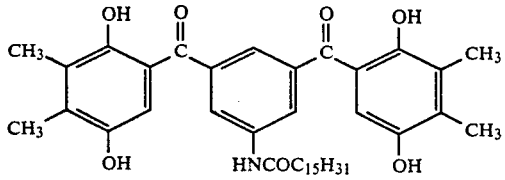

(39)

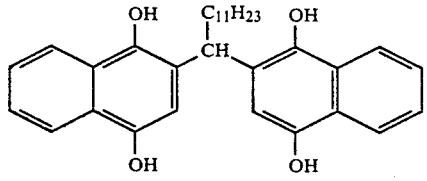

(40)

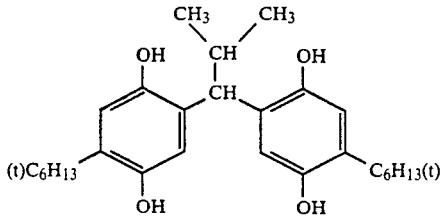

(41)

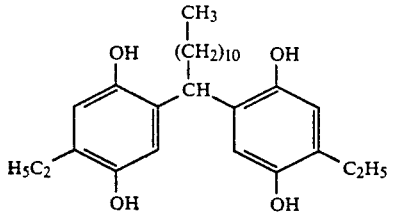

(42)

Further, the compounds disclosed in JP-B-56-21145 can also be used.

Compounds of the formula (I) in the present invention can be prepared in general using the methods disclosed, for example, in U.S. Pat. No. 2,735,765 and JP-B-56-21145.

The compounds of the formular (I) in the present invention are added to a silver halide emulsion layer. The addition of these compounds to a silver halide emulsion layer enables the effect of the present invention to be achieved. The amount of the compound of the formula (I) added is generally from 1 to 20 mol %, and for the present invention preferably from 3 to 10 mol % and more preferably from 3 to 5 mol %, per mol of coupler in the layer in which the compound is added.

The photosensitive materials of the present invention should have, on a support, at least one blue-sensitive layer, at least one green-sensitive layer and at least one red-sensitive layer, but no particular limitation is imposed upon the number or order of the silver halide emulsion layers and the nonphotosensitive layers (i.e., insensitive layers). Typically, silver halide photographic materials have at least one photosensitive layer comprising a plurality of silver halide layers which have essentially the same color sensitivity but different photographic speeds on a support, and the photosensitive layer is a unit photosensitive layer which is color-sensitive to blue light, green light or red light. In multilayer silver halide color photographic materials, the arrangement of the unit photosensitive layers generally involves positioning the layer in order, from the support side, of a red-sensitive layer, a green-sensitive layer, a blue-sensitive layer. However, this order may be reversed, if desired, and the layers may be arranged in such a way that layers which have a different color sensitivity are sandwiched between layers which have the same color sensitivity.

Various nonphotosensitive layers (i.e., insensitive layers), such as intermediate layers, may be provided between the silver halide photosensitive layers, and as uppermost and lowermost layers.

The intermediate layers may contain couplers and DIR compounds, for example, as disclosed in the specifications of JP-A-61-43748, JP-A-59-113438, JP-A-59-113440, JP-A-61-20037 and JP-A-61-20038, and they may also contain anti-color-mixing compounds which are normally used (the term "JP-A" as used herein refers to a "published unexamined Japanese patent application").

The plurality of silver halide emulsion layers of each unit photosensitive layer have preferably a double layer structure comprising a high speed emulsion layer and a low speed emulsion layer as disclosed in the specification of West German Patent 1,121,470 or British Patent 923,045. Normally, arrangements in which the photographic speed is lower in the layer closer to the support are preferred, and nonphotosensitive layers (insensitive layers) may be positioned between each of the silver halide emulsion layers. Furthermore, arrangements in which the low speed layers are arranged further away from the support and the high speed layers are arranged on the side closer to the support as disclosed, for example, in JP-A-57-112751, JP-A-62-200350, JP-A-62-206541 and JP-A-62-206543, can also be used.

For example, the arrangement may be, from the side furthest from the support, low speed blue-sensitive layer (BL)/high speed blue-sensitive layer (BH)/high speed green-sensitive layer (GH)/low speed green-sensitive layer (GL)/high speed red-sensitive layer (RH)/low speed red-sensitive layer (RL), or BH/BL/GL/GH/RH/RL, or BH/BL/GH/GL/RL/RH.

Furthermore, the layers can be arranged in the order, from the side furthest from the support, of blue-sensitive layer/GH/RH/GL/RL as disclosed in JP-B-55-34932. Even further, the layers can also be arranged in the order, from the side furthest away from the support, of blue-sensitive layer/GL/RL/GH/RH, as disclosed in the specifications of JP-A-56-25738 and JP-A-62-63936.

Moreover, structures in which there are three layers which have different speeds with the speed decreasing towards the support with a high speed silver halide emulsion layer at the top, a silver halide emulsion layer which has a lower speed than the above-described layer as an intermediate layer and a silver halide emulsion layer which has a lower speed than the intermediate layer as a bottom layer, as disclosed in JP-B-49-15495, can also be used. In structures of this type which have three layers cf different speeds, the layers in a layer having the same color sensitivity may be arranged in the order, from the side furthest from the support, of medium speed emulsion layer/high speed emulsion layer/-low speed emulsion layer, as disclosed in the specification of JP-A-59-202464.

As described above, the various structural layers and the layer arrangements can be selected depending on the purpose of the photosensitive materials.

Where the photographic photosensitive materials of the present invention are color negative films or color reversal films, the preferred silver halide in the photographic emulsion layers is a silver iodobromide, silver iodochloride or silver iodochlorobromide which contains not more than about 30 mol % of silver iodide. Most preferably, the silver halide is a silver iodobromide or silver iodochlorobromide which contains from about 2 mol % to about 25 mol % of silver iodide.

Where the photographic photosensitive materials of the present invention are color printing papers, silver chlorobromides or silver chloride which are substantially silver iodide free is preferred for the silver halide which is present in the photographic emulsion layer. Here, the term "substantially silver iodide free" signified a silver iodide content of generally not more than 1 mol %, and preferably not more than 0.2 mol %. Silver chlorobromide emulsions with any silver bromide/silver chloride ratio can be used. This ratio can be varied over a wide range, depending on the intended purpose, but the use of silver chloride contents of at least 2 mol % is preferred. The use of the so-called high silver chloride emulsions which have a high silver chloride content is especially preferred in photosensitive materials which are suitable for rapid processing. The silver chloride content of these high silver chloride emulsions is preferably above 90 mol %, and most preferably above 95 mol %. The use of more or less pure silver chloride emulsions in which the silver chloride content is from 98 to 100 mol % is also preferred from the viewpoint of reducing the replenishment rate (i.e., the amount of replenisher) of the development processing bath.

The silver halide grains in the photographic emulsion may have a regular crystalline form, such as a cubic, octahedral or tetradecahedral form, an irregular crystalline form, such as a spherical or plate-like form, a form which has crystal defects, such as twinned crystal planes, or a form which is a composite of these forms.

The grain size of the silver halide may be very fine, i.e., about 0.2 μm or less, or large with a projected area diameter of up to about 10 μm, and the emulsions may be polydisperse emulsions or monodisperse emulsions.

The photographic emulsions which can be used in the present invention can be prepared, for example, using the methods disclosed in *Research Disclosure (Rd)*, No. 17643 (December, 1978), pages 22–23, "I. Emulsion Preparation and Types", Research Disclosure, No. 18716 (November, 1979), page 648, P. Glafkides, *Chimie et Physique Photographique*, Paul Montel (1966), G. F. Duffin, *Photographic Emulsion Chemistry*, Focal Press (1966), and V. L. Zelikman et al., *Making and Coating Photographic Emulsions*, Focal Press (1964).

The monodispersions disclosed, for example, in U.S. Pat. Nos. 3,574,628 and 3,655,394, and British Patent 1,413,748 are preferred.

Furthermore, tabular grains which have an aspect ratio of at least about 5 can be used in the present invention. Tabular grains can be prepared easily using the methods described, for example, in Gutoff, *Photographic Science and Engineering*, Vol. 14, pages 248–257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions. Alternatively, the grains may have a layered structure and, moreover, silver halides which have different compositions may be joined with an epitaxial junction or they may be joined with compounds other than silver halides, such as silver thiocyanate or lead oxide, for example. Mixtures of grains which have various crystalline forms can also be used.

The silver halide emulsions used normally are subjected to physical ripening, chemical ripening and spectral sensitization. Additives which are used in such processes are disclosed in *Research Disclosure*, Nos. 17643 and 18716, and these disclosures are summarized in the table below.

Known photographically useful additives which can be employed in the present invention are also disclosed in the *Research Disclosures* referred to above, and the locations of these disclosures are also shown below.

| Additives | RD 17643 | RD 18716 |
|---|---|---|
| 1. Chemical Sensitizers | Page 23 | Page 648, right column |
| 2. Sensitivity Increasing Agents | — | " |
| 3. Spectral Sensitizers, Supersensitizers | Pages 23–24 | Page 648, right column to page 649, right column |
| 4. Brightening Agents | Page 24 | — |
| 5. Antifoggants and | Pages 24–25 | Page 649, right column |

-continued

| Additives | RD 17643 | RD 18716 |
|---|---|---|
| Stabilizers | | |
| 6. Light Absorbers, Filter Dyes, Ultraviolet Absorbers | Pages 25–26 | Page 649, right column to page 650, left column |
| 7. Antistaining Agents | Page 25, right column | Page 650, left to right columns |
| 8. Dye Image Stabilizers | Page 25 | — |
| 9. Hardeners | Page 26 | Page 651, left column |
| 10. Binders | Page 26 | " |
| 11. Plasticizers, Lubricants | Page 27 | Page 650, right column |
| 12. Coating Aids, Surface Active Agents | Pages 26–27 | " |
| 13. Antistatic Agents | Page 27 | " |

Furthermore, the addition of the compounds which react with and fix formaldehyde disclosed in U.S. Pat. Nos. 4,411,987 and 4,435,503 to the photosensitive materials is preferred to prevent a decrease in photographic performance due to formaldehyde.

Various color couplers can be used in the present invention, and specific examples are disclosed in the patents cited in the above-described *Research Disclosure*, No. 17643, sections VII-C-G.

Those disclosed, for example, in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249473A are preferred as yellow couplers.

5-Pyrazolone based compounds and pyrazoloazole based compounds are preferred as magenta couplers, and those disclosed, for example, in U.S. Pat. Nos. 4,310,619 and 4,351,897, European Patent 73636, U.S. Pat. Nos. 3,061,432 and 3,725,064, *Research Disclosure*, No. 24220 (June, 1984), JP-A-60-33552, *Research Disclosure*, No. 24230 (June, 1984), JP-A-60-43659, JP-A-61-72238, JP-A-60-35730, JP-A-55-118034, JP-A-60-185951, U.S. Pat. Nos. 4,500,630, 4,540,654 and 4,556,630, and WO (PCT) 88/04795 are especially preferred.

Phenol and naphthol based couplers are used as cyan couplers, and those disclosed, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent (Laid Open) 3,329,729, European Patents 121365A and 249453A, U.S. Pat. Nos. 3,446,622, 4,333,999, 4,753,871, 4,451,559, 4,427,767, 4,690,889, 4,254,212 and 4,296,199, and JP-A-61-42658 are preferred.

The colored couplers for correcting unwanted absorptions of colored dyes as disclosed, for example, in section VII-G of *Research Disclosure*, No. 17643, U.S. Pat. No. 4,163,670, JP-B-57-39413, U.S. Pat. Nos. 4,004,929 and 4,138,258, and British Patent 1,146,368 are preferred. Furthermore, the use of couplers which correct unwanted absorption of colored dyes by use of fluorescent dyes which are released on coupling as disclosed in U.S. Pat. No. 4,774,181 is also preferred.

Couplers where colored dyes are formed having a suitable degree of diffusibility disclosed in U.S. Pat. No. 4,366,237, British Patent 2,125,570, European Patent 96570 and West German Patent (Laid Open) 3,234,533 are preferred.

Typical examples of polymer dye forming couplers are disclosed, for example, in U.S. Pat. Nos. 3,451,820, 4,080,211, 4,367,282, 4,409,320 and 4,576,910, and British Patent 2,102,173.

The use of couplers which release photographically useful residual groups on coupling is preferred in the present invention. The DIR couplers which release developing inhibitors disclosed in the patents cited in section VII-F of the above-described *Research Disclosure*, No. 17643, JP-A-57-151944, JP-A-57-154234, JP-A-60-184248, JP-A-63-37346 and U.S. Pat. No. 4,248,962 are preferred.

The couplers disclosed in British Patents 2,097,140 and 2,131;188, JP-A-59-157638 and JP-A-59-170840 which are preferred as couplers which release nucleating agents or developing accelerators in imagewise relationship during development can also be used.

Other couplers which can be used in the photosensitive materials of the present invention include the competitive couplers disclosed, for example, in U.S. Pat. No. 4,130,427, the multiequivalent couplers disclosed, for example, in U.S. Pat. Nos. 4,283,472, 4,338,393 and 4,310,618, the DIR redox compound releasing couplers, DIR couplers releasing couplers, DIR coupler releasing redox compounds or DIR redox releasing redox compounds disclosed, for example, in JP-A-60-185950 and JP-A-62-24252, the couplers which release dyes where the color is restored after elimination disclosed in European Patent 173302A, the bleaching accelerator releasing couplers disclosed, for example, in *Research Disclosure*, Nos. 11449 and 24241, and JP-A-61-201247, the ligand releasing couplers disclosed, for example, in U.S. Pat. No. 4,553,477, the leuco dye releasing couplers disclosed in JP-A-63-75747, and the couplers which release fluorescent dyes disclosed in U.S. Pat. No. 4,774,181.

The couplers used in the present invention can be introduced into the photosensitive material using a variety of known dispersion methods.

Examples of high boiling point solvents which can be used in the oil-in-water dispersion method are disclosed, for example, in U.S. Pat. No. 2,322,027.

Examples of high boiling point organic solvents which have a boiling point of at least 175° C. at normal pressure which can be used in the oil-in-water dispersion method include phthalates (for example, dibutyl phthalate, dicyclohexyl phthalate, di-2-ethylhexyl phthalate, decyl phthalate, bis(2,4-di-tert-amylphenyl)phthalate, bis(2,4-di-tert-amylphenyl)isophthalate and bis(1,1-diethylpropyl)phthalate), phosphates or phosphonates (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate and di-2-ethylhexylphenyl phosphate), benzoates (for example, 2-ethylhexyl benzoate, dodecyl benzoate, 2-ethylhexyl-p-hydroxy benzoate), amides (for example, N,N-diethyldodecanamide, N,N-diethyllaurylamide and N-tetradecylpyrrolidone), alcohols or phenols (for example, isostearyl alcohol and 2,4-di-tert-amylphenol), aliphatic carboxylic acid esters (for example, bis(2-ethylhexyl)sebacate, dioctyl azelate, glycerol tributyrate, isostearyl lactate and trioctyl citrate), aniline derivatives (for example, N,N-dibutyl-2-butoxy-5-tertoctylaniline) and hydrocarbons (for example, paraffins, dodecylbenzene and diisopropylnaphthalate). Furthermore, organic solvents which have a boiling point of generally about 30° C. or more, and preferably from about 50° C. to about 160° C. can be used as auxiliary solvents. Typical examples of these solvents include ethyl acetate, butyl acetate, ethyl propionate, methyl ethyl ketone, cyclohexanone, 2-ethoxyethyl acetate and dimethylformamide.

Specific examples of the processes and effects of the latex dispersion method and specific examples of latexes for impregnation purposes are disclosed, for example, in U.S. Pat. No. 4,199,363 and West German Patent Application (OLS) Nos. 2,541,274 and 2,541,230.

Furthermore, these couplers can be impregnated onto loadable latex polymers (for example, U.S. Pat. No. 4,203,716) in the presence of or in the absence of the above-described high boiling point solvents, or they can be emulsified and dispersed in an aqueous hydrophilic colloid solution after dissolution in a water insoluble and organic solvent soluble polymer.

The use of the homopolymers or copolymers disclosed on pages 12 to 30 of the specification of International Patent No. WO 88/00723 is preferred. The use of acrylamide based polymers is preferred from the viewpoint of color image stabilization, etc.

The present invention can be applied to various types of color photosensitive materials. Typical examples include color negative films for general or cinematographic purposes, color reversal films for slides or video purposes, color papers, color positive films and color reversal papers.

Suitable supports which can be used in the present invention are disclosed, for example, on page 28 of the above-described *Research Disclosure*, No. 17643, and from the right column of page 647 to the left column of page 648 of *Research Disclosure*, No. 18716.

The photosensitive materials of the present invention preferably have a total film thickness of all of the hydrophilic colloid layers on the side where the emulsion layers are located of not more than 20 μm, and the film swelling rate ($T_{\frac{1}{2}}$) is not more than 30 seconds. The film thickness signifies the film thickness measured after adjustment (2 days) at 25° C. 55% relative humidity, and the film swelling rate ($T_{\frac{1}{2}}$) can be measured using the methods well known to those in the art. For example, measurements can be made using a swellometer of the type described in A. Green, *Photogr. Sci. Eng.*, Vol. 19, No. 2, pages 124–129, and $T_{\frac{1}{2}}$ is defined as the time required for the film thickness to reach 90% of the saturated film thickness which is taken to be 90% of the maximum swollen film thickness achieved on processing the material for 3 minutes 15 seconds in a color developing bath at 30° C.

The film swelling rate ($T_{\frac{1}{2}}$) can be adjusted by adding film hardening agents for the gelatin which is used as a binder, or by changing the conditions after coating. Furthermore, the swelling factor is preferably from 150% to 400%. The swelling factor can be calculated from the maximum swollen film thickness obtained under the conditions described above using the expression (maximum swollen film thickness-film thickness)-/film thickness.

The color photographic photosensitive materials to which the present invention is applicable can be developed and processed in the usual way as disclosed on pages 28 and 29 of the above-described *Research Disclosure*, No. 17643 and from the left column to the right column of page 615 of the above-described *Research Disclosure*, No. 18716.

The color developing baths used in the development processing of the photosensitive materials of the present invention are preferably aqueous alkaline solutions which contain a primary aromatic amine based color developing agent as the principal component. Aminophenol based compounds are useful as color developing agents, but the use of p-phenylenediamine based compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, and the sulfate, hydrochloride and p-toluenesulfonate salts of these compounds. Two or more of these compounds can be used in combination depending on the intended purpose.

The color developing baths generally contain pH buffers such as alkali metal carbonates, borates or phosphates, and developing inhibitors or antifoggants such as bromides, iodides, benzimidazoles, benzothiazoles or mercapto compounds. They may also contain, if desired, various preservatives such as hydroxylamine, diethylhydroxylamine, sulfites, hydrazines, phenylsemicarbazides, triethanolamines, catecholsulfonic acids and triethylenediamine(1,4-diazabicyclo[2,2,2]octanes; organic solvents such as ethylene glycol and diethylene glycol; developing accelerators such as benzyl alcohol, polyethylene glycol, quaternary ammonium salts and amines; color forming couplers; competitive couplers; fogging agents such as sodium borohydride; auxiliary developing agents such as 1-phenyl-3-pyrazolidone; viscosity imparting agents; various chelating agents as typified by the aminopolycarboxylic acids, aminopolyphosphonic acids, alkylphosphonic acids and phosphonocarboxylic acids (typical examples include ethylenediaminetetraacetic acid, nitrilotriacetic acid, hydroxyethyliminodiacetic acid, diethylenetriaminepentaacetic acid, 1-hydroxyethylidene-1,1-diphosphonic acid, cyclohexanediaminetetraacetic acid, nitrilo-N,N,N-trimethylenephosphonic acid, ethylenediamine-N,N,N,N-tetramethylenephosphonic acid, ethylenediaminedi(o-hydroxyphenylacetic acid) and the salts of these acids.

Color development is carried out after a normal black-and-white development where reversal processing is carried out. Known black-and-white developers, for example, dihydroxybenzenes such as hydroquinone, 3-pyrazolidones such as 1-phenyl-3-pyrazolidone or aminophenols such as N-methyl-p-aminophenol can be used individually, alone or in combination, can be present in the black-and-white developing baths.

The pH of these color developing baths and black-and-white developing baths is generally within the range from 9 to 12.

A replenishment rate of from 20 to 200 ml per square meter of silver halide photosensitive material of the color developing bath in the present invention is described below. Here, the term "replenishment rate" signifies the amount of so-called color developing bath replenisher which is used. The replenishment rate of the color developing bath of more than 200 ml per square meter of the photosensitive material is required to avoid the above-described problems in conventional techniques. That is to say, a replenishment rate of 200 ml per square meter of the photosensitive material is at the boundary between the range within which the present invention can be achieved and the region in which combinations of conventional techniques outside the scope of the present invention can be used. Furthermore, although some differences depending on the photosensitive material exist, when the replenishment rate is less than 20 ml per square meter of the photosensitive material, the carryover of processing baths due to the photosensitive material exceeds the replenishment rate, the processing bath is reduced in volume and continuous processing is essentially impossible. The replenishment rate of 20 ml per square meter of the photosensitive material is such that, although there are some differences depending on the photosensitive material, the rate of carry-over of the processing bath due to the photosensitive material is more or less equal to the replenishment rate and there is substantially no overflow. The preferred replenishment rate is from 20 ml to 120 ml per square meter of photosensitive material. The more preferred replenishment rate is from 20 ml to 100 ml per square meter of photosensitive material.

Additives may be present in the color developer replenisher to correct for deterioration with the passage of time and the concentration.

Here, the additives include water for diluting the concentrate, preservatives which are readily deteriorated with the passage of time and alkalis for increasing the pH.

When the replenishment rate is decreased, it is desirable that evaporation of the liquid and aerial oxidation should be prevented by minimizing the solution contact area with the air in the processing tank. Furthermore, the rate of replenishment can be reduced by using means of suppressing the accumulation of bromide ion in the developing bath.

The color development processing time is normally within the range from 2 to 5 minutes, but it is possible to shorten processing times with high temperatures and high pH levels, and by increasing the concentration of the color developing agent.

Furthermore, by minimizing the bromide ion content of the developing bath and including a comparatively large amount of chloride ion, it is possible to achieve excellent photographic properties and processing properties and to suppress any variation in photographic properties.

The photographic emulsion layer is subjected to a normal bleaching process after color development. The bleaching process may be carried out at the same time as fixing process (in a bleach-fixing process) or they may be carried out as a separate process. Moreover, a bleach-fixing process can be carried out after a bleaching process in order to speed up processing. Moreover, a bleach-fixing process can be carried out in two connected bleach-fixing baths, a fixing process can be carried out before a bleach-fixing process or a bleaching process can be carried out after a bleach-fixing process. Compounds of multivalent metals, such as iron(III), cobalt(III), chromium(IV) and copper(II); peracids, quinones and nitro compounds, for example, can be used as bleaching agents. Typical bleaching agents include ferricyanides; dichromates; organic complex salts of iron(III) or cobalt(III), for example, complex salts with aminopolycarboxylic acids such as ethylenediaminetetraacetic acid, diethylenetriaminepentaacetic acid, cyclohexahediaminetetraacetic acid, methyliminodiacetic acid, 1,3-diaminopropanetetraacetic acid and glycol ether diaminetetraacetic acid, or citric acid, tartaric acid or malic acid; persulfates; bromic acid salts; permanganates; and nitrobenzenes. Of these materials, the use of the polyaminocarboxylic acid iron(III) complex salts, principally ethylenediaminetetraacetic acid iron(III) complex salts, and persulfates, is preferred from the point of view of both rapid processing and the prevention of environmental pollution. Moreover, the aminopolycarboxylic acid iron(III) complex salts are especially useful in both bleaching baths and bleach-fixing baths. The pH of the bleaching baths and bleach-fixing baths in which these aminopolycarboxylic acid iron(III) complex salts are present is normally from 5.5 to 8, but lower pH values can be used to speed up processing.

Bleaching accelerators can be used, if desired, in the bleaching baths, bleach-fixing baths or bleaching or bleach-fixing prebaths. Specific examples of useful bleaching accelerators are known in the art. For example, the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure*, No. 17129 (June, 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561; the iodides disclosed in West German Patent 1,127,715 and JP-A-58-16235; the polyoxyethylene compounds disclosed in West German Patents 966,410 and 2,748,430; the polyamine compounds disclosed in JP-B-45-8836; the other compounds disclosed in JP-A-49-42434, JP-A-49-59644, JP-A-53-94927, JP-A-54-35727, JP-A-55-26506 and JP-A-58-163940; and the bromide ion can be used. Of these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially preferred. Moreover, the compounds disclosed in U.S. Pat. No. 4,552,834 are also preferred. These bleaching accelerators may also be present in the light-sensitive materials. These bleaching accelerators are especially effective when the color photosensitive materials for cameras are bleach-fixed.

Thiosulfates, thiocyanates, thioether based compounds, thioureas and large amounts of iodide can be used, for example, as fixing agents, but thiosulfates are normally used, and ammonium thiosulfate is particularly preferably used. Sulfites, bisulfites or carbonyl/bisulfite addition compounds are preferred as preservatives for bleach-fixing baths.

The silver halide color photographic materials of the present invention are usually subjected to a water washing process and/or stabilizing process after the desilvering process. The amount of washing water used in a washing process can be fixed within a wide range depending on the application and the nature (for example, the materials such as couplers used) of the photosensitive materials, the washing water temperature, the number of water washing tanks (the number of water washing stages) and the replenishment system, i.e., whether a countercurrent or cocurrent system is used, and various other conditions. The relationship between the amount of water used and the number of washing tanks in a multistage countercurrent system can be obtained using the method described in *Journal of the Society of Motion Picture and Television Engineers*, Vol. 64, pages 248–253 (May, 1955).

The amount of washing water can be greatly reduced by using the multistage countercurrent system noted in the above-described literature, but bacteria proliferate due to the increased residence time of the water in the tanks, and problems arise with the suspended matter which is produced becoming attached to the photosensitive material. The method in which the calcium ion and magnesium ion concentrations are reduced, as disclosed in JP-A-62-288838 is very effective as a means of overcoming this problem when processing color photosensitive materials of the present invention. Furthermore, the isothiazolone compounds and thiabendazoles disclosed in JP-A-57-8542, the chlorine based disinfectants such as chlorinated sodium isocyanurate, and benzotriazole, for example, and the disinfectants disclosed in Horiguchi, *The Chemistry of Biocides and Fungicides*, in *Killing Microorganisms, Biocidal and Fungicidal Techniques* published by the Health and Hygiene Technical Society, and in *A Dictionary of Biocides and Fungicides* published by the Japanese Biocide and Fungicide Society, can also be used as well.

The pH of the water washing water when processing the photosensitive materials of the present invention is generally from 4 to 9, and preferably from 5 to 8. The washing water temperature and the washing time can be varied in accordance with the nature and application of the photosensitive material. However, in general, washing conditions of from 20 seconds to 10 minutes at a temperature of from 15° C. to 45° C., and preferably of from 30 seconds to 5 minutes at a temperature of from 25° C. to 40° C. are employed. Moreover, the photosensitive materials of the present invention can be processed directly in a stabilizing bath instead of being subjected to a watering wash as described above. Known methods disclosed in JP-A-57-8543, JP-A-58-14834 and JP-A-60-220345 can be used for this purpose.

Furthermore, in some cases a stabilizing process is carried out following the above-described water washing process, and the stabilizing baths which contain formaldehyde and a surfactant which are used as final baths for color camera photosensitive materials are used. Various chelating agents and fungicides can also be present in these stabilizing baths.

The overflowing solution which accompanies replenishment of the above-described water washing or stabilizing baths can be reused in other processes such as the desilvering process.

Color developing agents can be incorporated into a silver halide color photosensitive material of the present invention to simplify and speed up processing. The incorporation of various color developing agent precursors is preferred. For example, the indoaniline based compounds disclosed in U.S. Pat. No. 3,342,597, the Shiff's base type compounds disclosed in U.S. Pat. No. 3,342,599 and *Research Disclosure*, Nos. 14850 and 15159, the aldol compounds disclosed in *Research Disclosure*, No. 13924, the metal complex salts disclosed in U.S. Pat. No. 3,719,492 and the urethane based compounds disclosed in JP-A-53-135628 can be used for this purpose.

Various 1-phenyl-3-pyrazolidones can be incorporated, if desired, into the silver halide color photosensitive materials of the present invention with a view to accelerating color development. Typical compounds of this type are disclosed, for example, in JP-A-56-64339, JP-A-57-144547 and JP-A-58-115438.

The various processing baths in the present invention are used at a temperature of from 10° C. to 50° C. The standard temperature is normally from 33° C. to 38° C., but accelerated processing and shortened processing times can be achieved at higher temperatures while, on the other hand, improved picture quality and better processing bath stability can be achieved at lower temperatures. Furthermore, processes using hydrogen peroxide intensification or cobalt intensification as disclosed in West German Patent 2,226,770 or U.S. Pat. No. 3,674,499 can be used in order to reduce the amount of silver in the photosensitive material.

Illustrative examples of the present invention are described below, but the present invention is not to be construed as being limited by these examples. Unless otherwise indicated, all parts, percents, ratios and the like are by weight.

EXAMPLE 1

A multilayer color printing paper of the layer structure described below was prepared on a paper support which had been laminated on both sides with polyethylene. The coating liquids were prepared by the manner described below.

Preparation of the First Layer Coating Liquid

Ethyl acetate (27.2 ml), 4.1 g of solvent (Solv-3) and 4.1 g of solvent (Solv-6) were added to 19.1 g of yellow coupler (ExY), 4.4 g of color image stabilizer (Cpd-1) and 1.8 g of color image stabilizer (Cpd-7). The resulting solution was then emulsified and dispersed in 185 ml of a 10% aqueous gelatin solution which contained 8 ml of 10% sodium dodecylbenzenesulfonate. On the other hand, a silver chlorobromide emulsion (comprising a $\frac{1}{3}$ (silver ratio) mixture of a cubic emulsion having silver bromide content of 80.0 mol %, average grain size of 0.85 μm and variation coefficient of 0.08, and a cubic emulsion having silver bromide content of 80.0 mol %, average grain size of 0.62 μm, variation coefficient of 0.07) was fulfur sensitized and $5.0\times10^{-4}$ mol per mol of silver of the blue sensitizing dye shown below was added. This emulsion was then mixed with the above-described emulsified dispersion and a First Layer coating liquid was prepared. The coating liquids for the Second to the Seventh Layers were prepared using the same procedure as described to prepare the First Layer coating liquid. Moreover, 1-oxy-3,5-dichloro-s-triazine, sodium salt, was used as a gelatin hardening agent in each layer.

The spectral sensitizing dyes used in each layer are shown below.

Blue-Sensitive Emulsion Layer

-continued

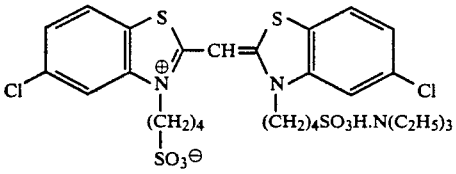

($5.0 \times 10^{-4}$ mol per mol of silver halide)

Green-Sensitive Emulsion Layer

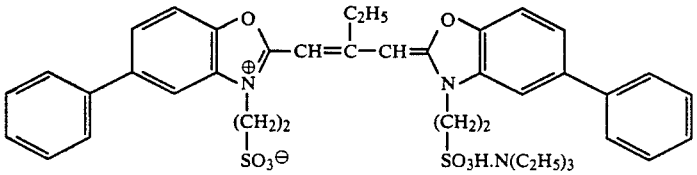

($4.0 \times 10^{-4}$ mol per mol of silver halide)

and

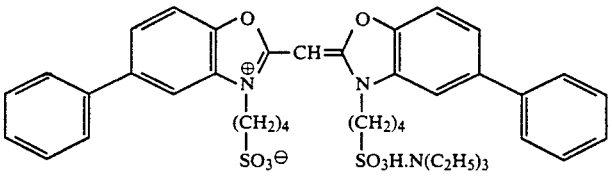

($7.0 \times 10^{-5}$ mol per mol of silver halide)

Red-Sensitive Emulsion Layer

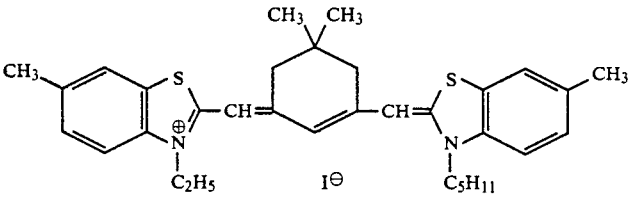

($0.9 \times 10^{-4}$ mol per mol of silver halide)

The compound shown below was added to the red-sensitive emulsion layer at a rate of $2.6 \times 10^{-3}$ mol per mol of silver halide.

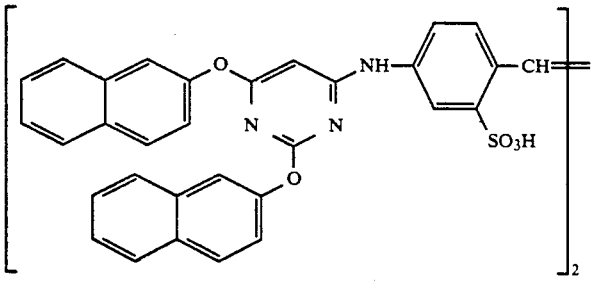

Further, 1-(5-methylureidophenyl)-5-mercaptotetrazole was added at rates, per mol of silver halide, of $4.0 \times 10^{-6}$ mol, $3.0 \times 10^{-5}$ mol and $1.0 \times 10^{-5}$ mol, respectively, and 2-methyl-5-tert-octylhydroquinone was added at rates, per mol of silver halide, of $8 \times 10^{-3}$ mol, $2 \times 10^{-2}$ mol and $2 \times 10^{-2}$ mol, respectively, to the blue-sensitive, green-sensitive and red-sensitive emulsion layers.

Furthermore, 4-hydroxy-6-methyl-1,3,3a,7-tetraazaindene was added at rates, per mol of silver halide, of $1.2 \times 10^{-2}$ mol and $1.1 \times 10^{-2}$ mol, respectively, to the blue-sensitive and green-sensitive emulsion layers.

The dyes shown below were added to the emulsion layers for antiirradiation purposes.

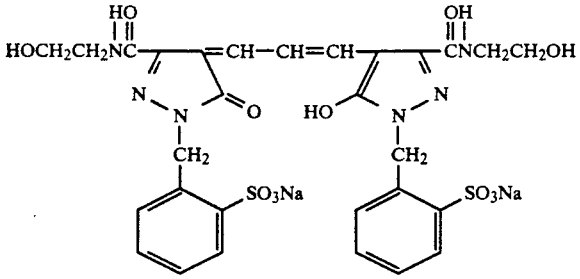

and

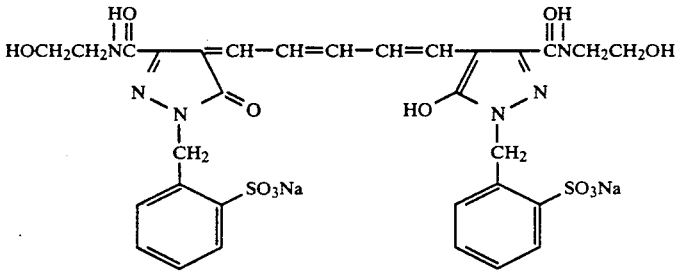

Layer Structure

The composition of each layer is shown below. The numerical values indicate the coated weights (g/m$^2$). The coated weight of the silver halide emulsions is shown as the coated weight calculated as silver.

Support

Polyethylene Laminated Paper (white pigment ($TiO_2$) and bluish dye (ultramarine) were included in the polyethylene on the first layer side)

| | |
|---|---|
| First Layer: Blue-Sensitive Layer | |
| Above-Described Silver Chlorobromide Emulsion (80 mol % AgBr) | 0.26 |
| Gelatin | 1.83 |
| Yellow Coupler (ExY) | 0.83 |
| Color Image Stabilizer (Cpd-1) | 0.19 |
| Color Image Stabilizer (Cpd-7) | 0.08 |
| Solvent (Solv-3) | 0.18 |
| Solvent (Solv-6) | 0.18 |
| Second Layer: Anti-Color-Mixing Layer | |
| Gelatin | 0.99 |
| Anti-Color-Mixing Agent (Cpd-6) | 0.08 |
| Solvent (Solv-1) | 0.16 |
| Solvent (Solv-4) | 0.08 |
| Third Layer: Green-Sensitive Layer | |
| Silver Chlorobromide Emulsion (a cubic emulsion of AgBr content: 90 mol %, average grain size: 0.47 μm, variation coefficient: 0.12 and a cubic emulsion of AgBr content: 90 mol %, average grain size: 0.36 μm, variation coefficient: 0.09 mixed in the molar proportions (as silver) of 1/1) | 0.16 |
| Gelatin | 1.79 |

-continued

| | |
|---|---|
| Magenta Coupler (ExM) | 0.32 |
| Color Image Stabilizer (Cpd-3) | 0.20 |
| Color Image Stabilizer (Cpd-8) | 0.03 |
| Color Image Stabilizer (Cpd-4) | 0.01 |
| Color Image Stabilizer (Cpd-9) | 0.04 |
| Solvent (Solv-2) | 0.65 |
| Fourth Layer: Ultraviolet Absorbing Layer | |
| Gelatin | 1.58 |
| Ultraviolet Absorber (UV-1) | 0.47 |
| Anti-Color-Mixing Agent (Cpd-5) | 0.05 |
| Solvent (Solv-5) | 0.24 |
| Fifth Layer: Red-Senstive Layer | |
| Silver Chlorobromide Emulsion (a cubic emulsion of AgBr content: 70 mol %, average grain size: 0.49 μm, variation coefficient: 0.08 and a cubic emulsion of AgBr content: 70 mol %, average grain size: 0.34 μm, variation coefficient: 0.10 mixed in molar proportions (as silver) of ½) | 0.23 |
| Gelatin | 1.34 |
| Cyan Coupler (ExC) | 0.30 |
| Color Image Stabilizer (Cpd-6) | 0.17 |
| Color Image Stabilizer (Cpd-7) | 0.40 |
| Solvent (Solv-6) | 0.20 |
| Compound of the Present Invention | See Table 1 |
| Sixth Layer: Ultraviolet Absorbing Layer | |
| Gelatin | 0.53 |
| Ultraviolet Absorber (UV-1) | 0.16 |
| Anti-Color-Mixing Agent (Cpd-5) | 0.02 |
| Solvent (Solv-5) | 0.08 |
| Seventh Layer: Protective Layer | |
| Gelatin | 1.33 |
| Acrylic Modified Poly(vinyl alcohol) Copolymer (17% modification) | 0.17 |
| Liquid Paraffin | 0.03 |

(Cpd-1) Color Image Stabilizer

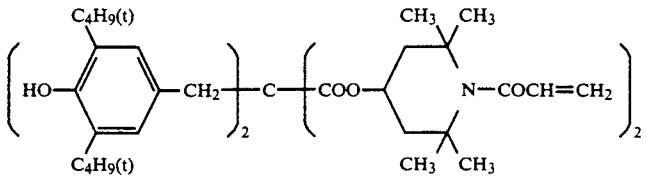

-continued
(Cpd-3) Color Image Stabilizer
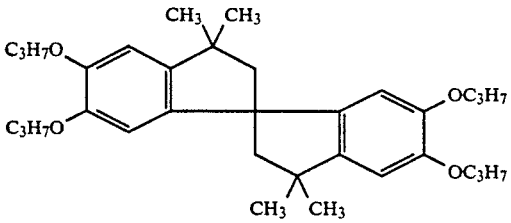
(Cpd-4) Color Image Stabilizer
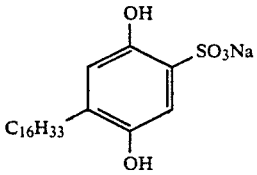
(Cpd-5) Anti-Color-Mixing Agent
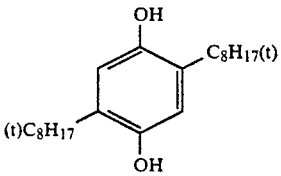
(Cpd-6) Color Image Stabilizer
A 2/4/4 (by weight) mixture of:
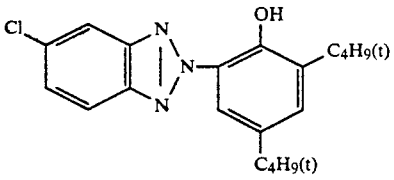
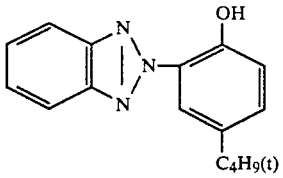
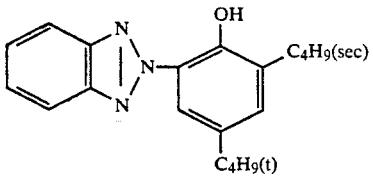
(Cpd-7) Color Image Stabilizer
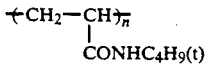
Average Molecular Weight: 80,000
(Cpd-8) Color Image Stabilizer
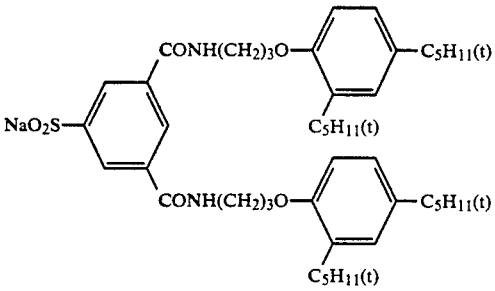

-continued
(Cpd-9) Color Image Stabilizer
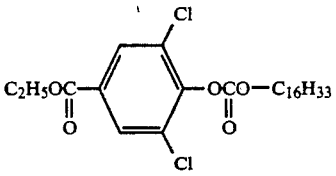
(UV-1) Ultraviolet Absorber
A 4/2/4 (by weight) mixture of:
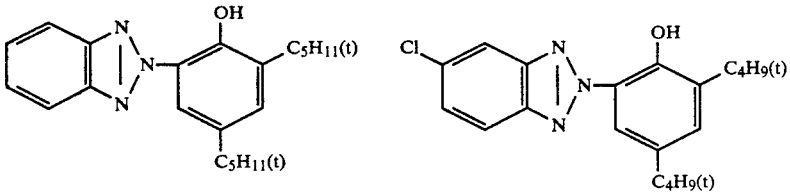
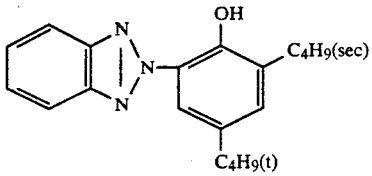
(Solv-1) Solvent
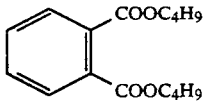
(Solv-2) Solvent
A 2/1 (by volume) mixture of:
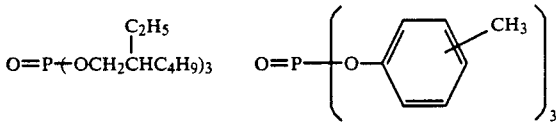
(Solv-3) Solvent
$O{=}P{+}O{-}C_9H_{19}(iso))_3$
(Solv-4) Solvent
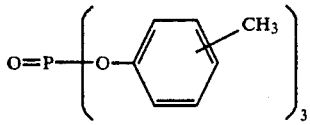
(Solv-5) Solvent
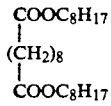
(Solv-6) Solvent
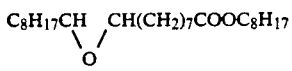

-continued (ExY) Yellow Coupler

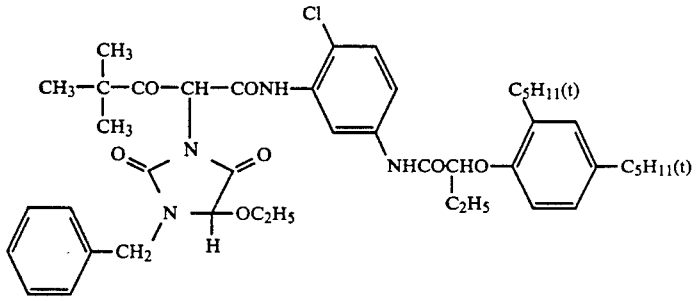

(ExM) Magenta Coupler

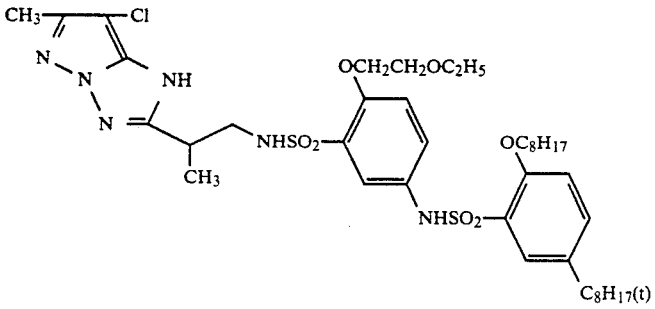

(ExC) Cyan Coupler

A 1/1 (mol ratio) mixture of:

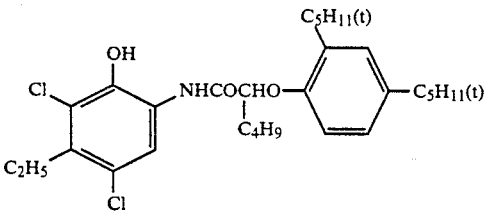

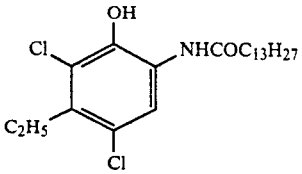

After imagewise exposure, the above-described photosensitive samples were subjected to continuous processing (in a running test) using a color paper processor model FPRP115 (produced by Fuji Photo Film Co., Ltd.) with the processing operations shown below until the color developer had been replenished to an extent of twice the tank capacity.

| Processing Operation | Temperature (°C.) | Time | Replenishment Rate* | Tank Capacity (liter) |
|---|---|---|---|---|
| Color Development | 37 | 3 min 30 sec | 200 ml | 60 |
| Bleach-Fixing | 33 | 1 min 30 sec | 55 ml | 40 |
| Water Washing (1) | 24–34 | 1 min | — | 20 |
| Water Washing (2) | 24–34 | 1 min | — | 20 |
| Water Washing (3) | 24–34 | 1 min | 10 liters | 20 |
| Drying | 70–80 | 1 min | | |

*Per square meter of photosensitive material.
Water washing was carried out with a three tank cascade from (3) to (1).

The composition of each processing bath was as follows:

| | Tank |
|---|---|

-continued

| | Solution | Replenisher |
|---|---|---|
| Color Developing Bath: | | |
| Water | 800 ml | 800 ml |
| Diethylenetriaminepentaacetic Acid | 1.0 g | 1.0 g |
| Nitrilotriacetic Acid | 2.0 g | 2.0 g |
| Benzyl Alcohol | 15 ml | 23 ml |
| Diethylene Glycol | 10 ml | 10 ml |
| Sodium Sulfite | 2.0 g | 3.0 g |
| Potassium Bromide | 1.2 g | — |
| Potassium Carbonate | 30 g | 25 g |
| N-Ethyl-N-(β-methanesulfonamidoethyl)-3-methyl-4-aminoaniline Sulfate | 5.0 g | 9.0 g |
| Hydroxylamine Sulfate | 3.0 g | 4.5 g |
| Fluorescent Whitener (Whitex 4B, made by Suminoto Chemicals) | 1.0 g | 2.0 g |
| Water to make | 1,000 ml | 1,000 ml |
| pH (25° C.) | 10.20 | 10.80 |
| Bleach Fixing Bath: | | |
| Water | 400 ml | 400 ml |
| Ammonium Thiosulfate (70 wt % aq. soln.) | 150 ml | 300 ml |
| Sodium Sulfite | 13 g | 26 g |
| Ethylenediaminetetraacetic Acid Fe(III) Ammonium Salt | 55 g | 110 g |
| Ethylenediaminetetraacetic Acid Disodium Salt | 5 g | 10 g |
| Water to make | 1,000 ml | 1,000 ml |
| pH (25° C.) | 6.70 | 6.30 |

-continued

Comparative Compounds

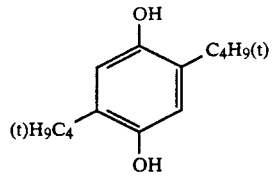

(A-2)

It is clearly seen from the results in Table 1 that Photosensitive Material 101 has poor gradation. Furthermore, Photosensitive Materials 102 and 103 to which Compounds A-1 and A-2 had been added to improve gradation clearly did not have both gradation and processing stability. In comparison with these materials, the photographic materials containing the compounds of the present invention gave excellent results in terms of Dmin, Dmax and gradation and there was no change on running the processor. Photosensitive Material 118 contained a compound of the present invention but, as disclosed in Example 1 of JP-B-56-21145, it was in this case added to intermediate layers, and no gradation controlling effect was observed because the compound was not added to an emulsion layer. Further, as described in Example 2 of JP-B-56-21145, Photographic Material 119 was processed by the same manner as in Photographic Material 117 except that the compound was used in an amount of 15 mol % per the coupler. But the Dmax was decreased and the gradation was also deteriorated (i.e., the value of the gradation was decreased). Accordingly, no gradation controlling effect was observed.

TABLE 1

| Photosensitive Material | Compound of the Invention* | Photographic Properties ($D_R$) Fresh Bath Dmin | Dmax | Gradation | Running Bath Dmin | Dmax | Gradation | Remarks |
|---|---|---|---|---|---|---|---|---|
| 101 | — | 0.12 | 2.60 | 2.04 | 0.11 | 2.54 | 2.01 | Comparison |
| 102 | (A-1) | 0.13 | 2.42 | 1.91 | 0.11 | 2.38 | 1.90 | " |
| 103 | (A-2) | 0.12 | 2.39 | 2.89 | 0.11 | 2.01 | 1.85 | " |
| 104 | (1) | 0.11 | 2.61 | 2.90 | 0.11 | 2.59 | 2.80 | Invention |
| 105 | (2) | 0.10 | 2.60 | 2.88 | 0.12 | 2.58 | 2.79 | " |
| 106 | (7) | 0.11 | 2.59 | 2.90 | 0.11 | 2.60 | 2.71 | " |
| 107 | (9) | 0.12 | 2.61 | 2.91 | 0.11 | 2.59 | 2.89 | " |
| 108 | (10) | 0.12 | 2.61 | 2.89 | 0.12 | 2.58 | 2.87 | " |
| 109 | (11) | 0.12 | 2.59 | 2.88 | 0.11 | 2.57 | 2.80 | " |
| 110 | (13) | 0.11 | 2.60 | 2.90 | 0.12 | 2.56 | 2.79 | " |
| 111 | (14) | 0.12 | 2.58 | 2.89 | 0.12 | 2.54 | 2.88 | " |
| 112 | (17) | 0.12 | 2.49 | 2.71 | 0.12 | 2.49 | 2.69 | " |
| 113 | (19) | 0.11 | 2.56 | 2.79 | 0.12 | 2.58 | 2.81 | " |
| 114 | (21) | 0.12 | 2.52 | 2.81 | 0.12 | 2.46 | 2.80 | " |
| 115 | (35) | 0.13 | 2.49 | 2.80 | 0.12 | 2.46 | 2.77 | " |
| 116 | (39) | 0.12 | 2.48 | 2.80 | 0.12 | 2.41 | 2.76 | " |
| 117 | (42) | 0.12 | 2.41 | 2.70 | 0.12 | 2.40 | 2.67 | " |
| 118** | (42) | 0.12 | 2.60 | 2.04 | 0.13 | 2.54 | 2.01 | Comparison |

*Added at a rate of 5 mol % based on the coupler.

**A photosensitive material the same as Photosensitive Material 101 except that the compound of the present invention was used at a rate of 0.08 g/m$^2$ in the Second and Fourth Layers of Photosensitive Material 101.

Comparative Compounds

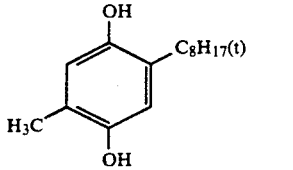

(A-1)

EXAMPLE 2

Processing was carried out in the same manner as in Example 1 after preparing the same photosensitive materials as described in Example 1 except that 5 mol %, based on the coupler, of the compound of the present invention was added to the Third Layer, the green-sensitive layer, of Photosensitive Material 101 prepared in Example 1. Photographic evaluation was carried out as to Dmin, Dmax and gradation. Furthermore, the processed samples were exposed to light for 140 hours in a xenon fadometer (95,000 lux) after the initial measurements had been made and then the measurements were repeated in order to evaluate the light fastness of the images. The evaluation of image light fastness (fading factor) was made in terms of the percentage decrease in density from a density of 1.0 before exposure in the xenon fadometer. A large numerical value indicates excellent image light fastness. The results obtained are shown in Table 2 below.

TABLE 2

| Photo-sensitive Material | Compound of the Invention* | Photographic Properties ($D_G$) Fresh Bath Dmin | Dmax | Gradation | Running Bath Dmin | Dmax | Gradation | Fading Factor (%) | Remarks |
|---|---|---|---|---|---|---|---|---|---|
| 201 | — | 0.12 | 2.94 | 2.11 | 0.12 | 2.93 | 2.09 | 77 | Comparison |
| 202 | (A-2) | 0.12 | 2.86 | 2.84 | 0.11 | 2.42 | 2.31 | 61 | " |
| 203 | (A-1) | 0.12 | 2.41 | 1.81 | 0.12 | 2.40 | 1.76 | 59 | " |
| 204 | (1) | 0.12 | 2.91 | 2.89 | 0.12 | 2.84 | 2.87 | 76 | Invention |
| 205 | (2) | 0.12 | 2.90 | 2.87 | 0.11 | 2.87 | 2.80 | 75 | " |
| 206 | (3) | 0.11 | 2.87 | 2.89 | 0.12 | 2.84 | 2.77 | 78 | " |
| 207 | (5) | 0.12 | 2.89 | 2.89 | 0.12 | 2.82 | 2.86 | 79 | " |
| 208 | (12) | 0.11 | 2.86 | 2.82 | 0.11 | 2.84 | 2.69 | 77 | " |
| 209 | (15) | 0.12 | 2.89 | 2.84 | 0.12 | 2.86 | 2.71 | 72 | " |
| 210 | (18) | 0.11 | 2.86 | 2.84 | 0.12 | 2.81 | 2.74 | 76 | " |
| 211 | (20) | 0.12 | 2.87 | 2.82 | 0.12 | 2.86 | 2.84 | 78 | " |
| 212 | (22) | 0.11 | 2.89 | 2.81 | 0.12 | 2.80 | 2.74 | 78 | " |
| 213 | (23) | 0.12 | 2.87 | 2.83 | 0.12 | 2.79 | 2.73 | 74 | " |
| 214 | (28) | 0.12 | 2.86 | 2.81 | 0.12 | 2.76 | 2.70 | 77 | " |
| 215 | (33) | 0.11 | 2.84 | 2.79 | 0.11 | 2.81 | 2.70 | 77 | " |
| 216 | (34) | 0.11 | 2.85 | 2.74 | 0.11 | 2.79 | 2.65 | 78 | " |

*Added at a rate of 5 mol % based on the coupler.

It is clearly seen from the results in Table 2 that in those cases where compounds of the present invention had been used (Photosensitive Materials 204 to 216) the excellent photographic properties obtained in fresh baths were retained in the running test, and that they also had excellent light fastness.

Comparative Photosensitive Material 201 had good light fastness but there was a problem with low gradation. Compound (A-1) was added to Comparative Photosensitive Material 202 in order to overcome this problem and excellent gradation was obtained in fresh baths, but Dmax and gradation changed in the running test and there was also a reduction in light fastness. Dmax and the gradation were both low in the case of Comparative Photosensitive Material 203 and the light fastness was also poor.

It is thought that there was only a slight change in Dmax and gradation in the running test with the compounds of the present invention because there was no dissolving out into the processing baths.

EXAMPLE 3

A multilayer color printing paper, whose layer structure is described below, was prepared on a paper support which had been laminated on both sides with polyethylene. The coating liquids were prepared by the way described below.

Preparation of the First Layer Coating Liquid

Ethyl acetate (27.2 ml) and 8.2 g of solvent (Solv-3) were added to 19.1 g of yellow coupler (ExY), 4.4 g of color image stabilizer (Cpd-1) and 0.7 g of color image stabilizer (Cpd-7). The resulting solution was then emulsified and dispersed in 18.5 ml of a 10 wt % aqueous gelatin solution which contained 8 ml of 10 wt % sodium dodecylbenzenesulfonate. On the other hand, a silver chlorobromide emulsion (cubic, average grain size: 0.88 μm, variation coefficient of the grain size distribution: 0.08, silver bromide content: 0.2 mol % based on the whole grain, included in the grain surface) was sulfur-sensitized after adding $2.0\times10^{-4}$ mol per mol of silver of the blue-sensitive supersensitizing dyes shown below. The emulsion was then mixed with the above-described emulsified dispersion and the First Layer coating liquid was prepared to provide the composition indicated below. The coating liquids for the Second to the Seventh Layers were prepared using the same procedure as used to prepare the First Layer coating liquid. Moreover, 1-oxy-3,5-dichloro-s-triazine sodium salt was used as a gelatin hardening agent in each layer.

The spectral sensitizing dyes used in each layer were as shown below.

Blue-Sensitive Emulsion Layer

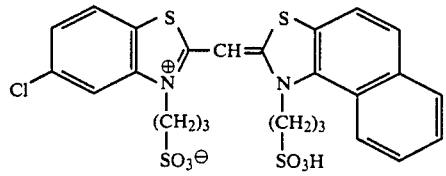

-continued

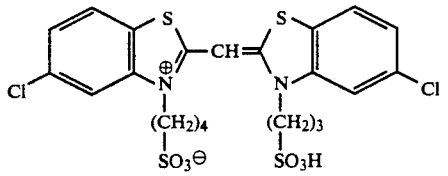

(2.0 × $10^{-4}$ mol of each per mol of silver halide)

Green-Sensitive Emulsion Layer

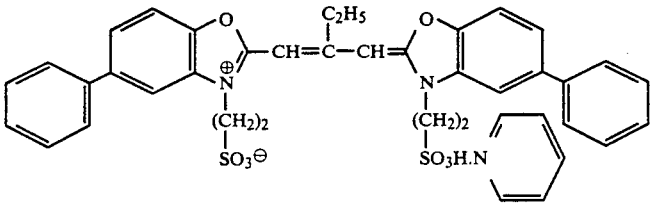

(4.0 × $10^{-4}$ mol per mol of silver halide)

and

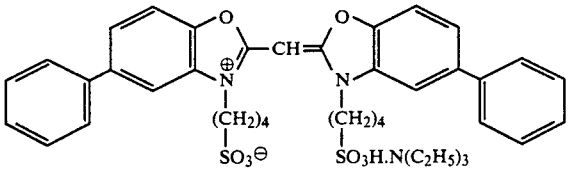

(7.0 × $10^{-5}$ mol per mol of silver halide)

Red-Sensitive Emulsion Layer

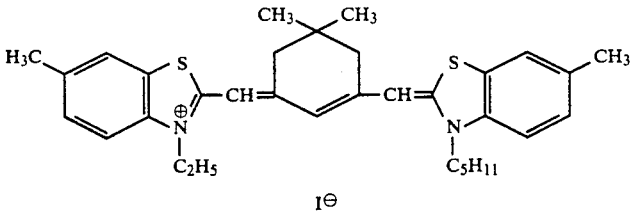

(0.9 × $10^{-4}$ mol per mol of silver halide)

The compound indicated below was added to the red-sensitive emulsion layer at a rate of $2.6\times10^{-3}$ mol per mol of silver halide.

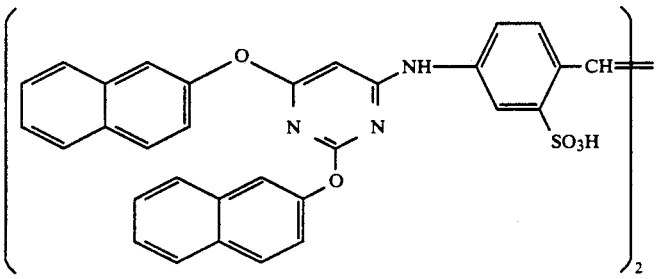

Furthermore, 1-(5-methylureidophenyl)-5-mercaptotetrazole was added at rates, per mol of silver halide, of $8.5\times10^{-5}$ mol, $7.7\times10^{-4}$ mol and $2.5\times10^{-4}$ mol, respectively, to the blue-sensitive, green-sensitive and red-sensitive emulsion layers.

The dyes shown below were added to the emulsion layers for antiirradiation purposes.

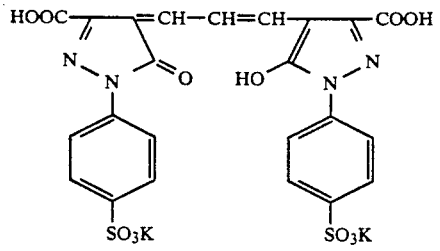

and

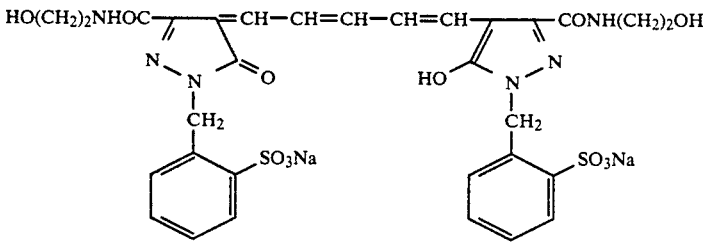

Layer Structure

The composition of each layer was as shown below. The numerical values shown the coated weights (g/m$^2$). The coated weight os silver halide emulsions is shown as the coated weight calculated as silver.

Support

Polyethylene Laminated Paper (white pigment ($TiO_2$) and bluish dye (ultramarine) were present in the polyethylene on the First Layer side)

| | |
|---|---|
| First Layer: Blue-Sensitive Layer) | |
| Above-Described Silver Chlorobromide Emulsion (see page 80) | 0.03 |
| Gelatin | 1.86 |
| Yellow Coupler (ExY) | 0.82 |
| Color Image Stabilizer (Cpd-1) | 0.19 |
| Solvent (Solv-3) | 0.35 |
| Color Image Stabilizer (Cpd-7) | 0.06 |
| Second Layer: Anti-Color-Mixing Layer | |
| Gelatin | 0.99 |
| Anti-Color-Mixing Agent (Cpd-5) | 0.08 |
| Solvent (Solv-1) | 0.16 |
| Solvent (Solv-4) | 0.08 |
| Third Layer: Green-Sensitive Layer | |
| Silver Chlorobromide Emulsion (a ⅓ (mol ratio as silver) mixture of cubic emulsions having average grain size: 0.55 μm, variation coefficients of the grain size distributions: 0.10 and 0.08, respectively, 0.8 mol % of the AgBr as a proportion of the whole grain present in the grain surface) | 0.12 |
| Gelatin | 1.24 |
| Magenta Coupler (ExM) | 0.27 |
| Color Image Stabilizer (Cpd-3) | 0.15 |
| Color Image Stabilizer (Cpd-8) | 0.02 |
| Color Image Stabilizer (Cpd-9) | 0.03 |
| Solvent (Solv-2) | 0.54 |
| Fourth Layer: Ultraviolet Absorbing Layer | |
| Gelatin | 1.58 |
| Ultraviolet Absorber (UV-1) | 0.47 |
| Anti-Color-Mixing Agent (Cpd-5) | 0.05 |
| Solvent (Solv-5) | 0.24 |
| Fifth Layer: Red-Sensitive Layer | |
| Silver Chlorobromide Emulsion (a ⅓ (mol ratio as silver) mixture of cubic emulsions having average grain size: 0.58 μm and 0.45 μm, variation coefficients of the grain size distributions: 0.09 and 0.11, | 0.23 |

-continued

| | |
|---|---|
| respectively, 0.6 mol % of the AgBr as a proportion of the whole grain present in the grain surface) | |
| Gelatin | 1.34 |
| Cyan Coupler (ExC) | 0.32 |
| Color Image Stabilizer (Cpd-6) | 0.17 |
| Color Image Stabilizer (Cpd-10) | 0.04 |
| Color Image Stabilizer (Cpd-7) | 0.40 |
| Solvent (Solv-6) | 0.15 |
| Compound of the Present Invention | See Table 3 |
| Sixth Layer: Ultraviolet Absorbing Layer | |
| Gelatin | 0.53 |
| Ultraviolet Absorber (UV-1) | 0.16 |
| Anti-Color-Mixing Agent (Cpd-5) | 0.02 |
| Solvent (Solv-5) | 0.08 |
| Seventh Layer: Protective Layer | |
| Gelatin | 1.33 |
| Acrylic Modified Poly(vinyl alcohol) Copolymer (17% modification) | 0.17 |
| Liquid Paraffin | 0.03 |

(ExY) Yellow Coupler
(Same as ExY in Example 1)
(ExM) Magenta Coupler

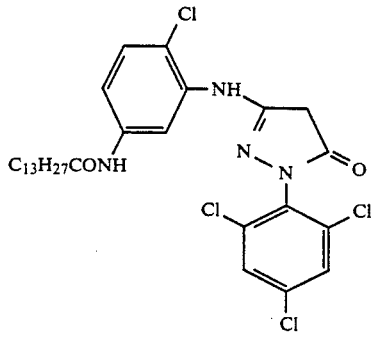

(ExC) Cyan Coupler

A 2/4/4 (by weight) mixture of:

-continued

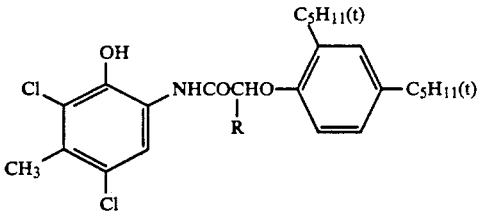

R = $C_2H_5$, $C_4H_9$

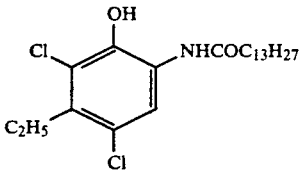

(Cpd-1) Color Image Stabilizer (Same as (Cpd-1) in Example 1)

(Cpd-3) Color Image Stabilizer (Same as (Cpd-3) in Example 1)

(Cpd-5) Anti-Color-Mixing Agent (Same as (Cpd-5) in Example 1)

(Cpd-6) Color Image Stabilizer (Same as (Cpd-6) in Example 1)

(Cpd-7) Color Image Stabilizer

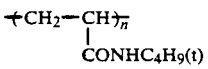

Average Molecular Weight: 60,000

(Cpd-8) Color Image Stabilizer (Same as (Cpd-8) in Example 1)

(Cpd-9) Color Image Stabilizer (Same as (Cpd-9) in Example 1)

(Cpd-10)

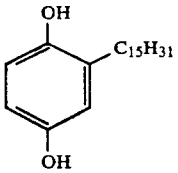

(UV-1) Ultraviolet Absorber (Same as (UV-1) in Example 1)

(Solv-1) Solvent (Same as (Solv-1) in Example 1)

(Solv-2) Solvent (Same as (Solv-2) in Example 1)

(Solv-3) Solvent (Same as (Solv-3) in Example 1)

(Solv-4) Solvent (Same as (Solv-4) in Example 1)

(Solv-5) Solvent (Same as (Solv-5) in Example 1)

(Solv-6) Solvent

-continued

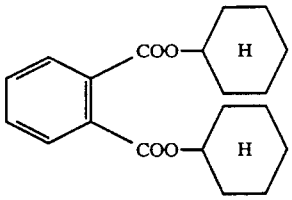

After exposure, the above-described photosensitive materials were subjected to continuous processing (in a running test) using a paper processor with the processing operations shown below until replenishment had been carried out to twice the color development tank capacity.

| Processing Operation | Temperature (°C.) | Time (sec) | Replenishment Rate* (ml) | Tank Capacity (liter) |
|---|---|---|---|---|
| Color Development | 35 | 45 | As shown in Table 3 | 17 |
| Bleach-Fixing | 30–36 | 45 | 161 | 17 |
| Rinsing (1) | 30–37 | 20 | — | 10 |
| Rinsing (2) | 30–37 | 20 | — | 10 |
| Rinsing (3) | 30–37 | 20 | — | 10 |
| Rinsing (4) | 30–37 | 30 | 248 | 10 |
| Drying | 70–80 | 60 | | |

*Per square meter of photosensitive material.

Water washing was carried out with a four counter current system from (4) to (1).

The composition of each processing bath was as shown below.

| | Tank Solution | Replenisher |
|---|---|---|
| Color Developing Bath | | |
| Water | 800 ml | 800 ml |
| Ethylenediamine-N,N,N,N-tetramethylenephosphonic Acid | 1.5 g | 1.5 g |
| Triethylenediamine (1,4-diazabicyclo[2,2,2]octane) | 5.0 g | 5.0 g |
| Sodium Chloride | 1.4 g | — |
| Potassium Carbonate | 25 g | 25 g |
| N-Ethyl-N-(β-methanesulfonamidoethyl)-3-methyl-4-aminoaniline Sulfate | 5.0 g | 7.0 g |
| Diethylhydroxylamine | 4.2 g | 6.0 g |
| Fluorescent Whitener (4,4,'-diaminostilbene based) | 2.0 g | 2.5 g |
| Water to make | 1,000 ml | 1,000 ml |
| pH (25° C.) | 10.05 | 10.45 |
| Bleach-Fixing Bath (tank solution = replenisher) | | |
| Water | 400 ml | |
| Ammonium Thiosulfate (70 wt % aq. soln.) | 100 ml | |
| Sodium Sulfite | 17 g | |
| Ethylenediaminetetraacetic Acid Fe(III) Ammonium Salt | 55 g | |
| Ethylenediaminetetraacetic Acid Disodium Salt | 5 g | |
| Ammonium Bromide | 40 g | |
| Glacial Acetic Acid | 9 g | |
| Water to make | 1,000 ml | |
| pH (25° C.) | 5.40 | |
| Rinsing Bath (tank solution = replenisher) | | |

Deionized water (amount of calcium and magnesium, respectively, is less than 3 ppm)

TABLE 3

| Photosensitive Material | Compound of the Invention* | Photographic Properties: Fresh Bath Dmin | Fresh Bath Dmax | Fresh Bath Gradation | Running Bath Dmin | Running Bath Dmax | Running Bath Gradation | Replenishment Rate of Color Developing Bath** (ml) | Remarks |
|---|---|---|---|---|---|---|---|---|---|
| 301 | — | 0.12 | 2.48 | 2.04 | 0.12 | 2.46 | 2.00 | 161 | Comparison |
| 302 | (A-1) | 0.12 | 2.41 | 2.91 | 0.12 | 1.74 | 1.91 | 161 | " |
| 303 | (A-3) | 0.12 | 2.38 | 2.92 | 0.12 | 1.60 | 1.82 | 161 | " |
| 304 | (1) | 0.12 | 2.48 | 2.91 | 0.12 | 2.47 | 2.90 | 161 | Invention |
| 305 | (2) | 0.12 | 2.49 | 2.90 | 0.13 | 2.46 | 2.88 | 161 | " |
| 306 | (3) | 0.11 | 2.46 | 2.87 | 0.12 | 2.41 | 2.80 | 161 | " |
| 307 | (5) | 0.12 | 2.47 | 2.86 | 0.11 | 2.40 | 2.83 | 161 | " |
| 308 | (7) | 0.12 | 2.46 | 2.89 | 0.11 | 2.40 | 2.88 | 161 | " |
| 309 | (9) | 0.13 | 2.49 | 2.88 | 0.11 | 2.40 | 2.87 | 161 | " |
| 310 | (10) | 0.12 | 2.48 | 2.87 | 0.12 | 2.40 | 2.86 | 161 | " |
| 311 | (11) | 0.12 | 2.42 | 2.89 | 0.11 | 2.31 | 2.79 | 161 | " |
| 312 | (12) | 0.12 | 2.47 | 2.86 | 0.12 | 2.31 | 2.69 | 161 | " |
| 313 | (13) | 0.11 | 2.48 | 2.91 | 0.11 | 2.39 | 2.81 | 161 | " |
| 314 | (14) | 0.10 | 2.49 | 2.88 | 0.11 | 2.41 | 2.85 | 161 | " |
| 315 | (15) | 0.12 | 2.47 | 2.86 | 0.12 | 2.41 | 2.79 | 161 | " |
| 316 | (17) | 0.11 | 2.46 | 2.84 | 0.11 | 2.40 | 2.80 | 161 | " |
| 301 | — | 0.12 | 2.48 | 2.04 | 0.13 | 2.11 | 1.80 | 120 | Comparison |
| 301 | — | 0.12 | 2.48 | 2.04 | 0.13 | 2.00 | 1.72 | 80 | " |
| 301 | — | 0.12 | 2.48 | 2.04 | 0.13 | 1.92 | 1.70 | 60 | " |
| 301 | — | 0.12 | 2.48 | 2.04 | 0.14 | 1.88 | 1.68 | 20 | " |
| 305 | (2) | 0.12 | 2.49 | 2.90 | 0.13 | 2.48 | 2.88 | 120 | Invention |
| 305 | (2) | 0.12 | 2.49 | 2.90 | 0.12 | 2.46 | 2.82 | 80 | " |
| 305 | (2) | 0.12 | 2.49 | 2.90 | 0.12 | 2.44 | 2.80 | 60 | " |
| 305 | (2) | 0.12 | 2.49 | 2.90 | 0.13 | 2.33 | 2.70 | 20 | " |

*Added at a rate of 5 mol % based on the coupler.
**Per square meter of photosensitive material.

It is clearly seen from the results in Table 3 that Photosensitive Materials 304 to 316 in which the compounds of the present invention were used exhibited good photographic properties in fresh baths and, at the same time, marked variation in photographic properties on running was clearly suppressed.

Furthermore, when the replenishment rate was 120 ml/m$^2$ or below there was a pronounced decrease in color formation with the comparative examples but there was very little change in photographic properties with the samples of the present invention.

With the present invention, it is possible to obtain, in continuous processing in which the replenishment rate of the color developing bath is greatly reduced, satisfactory maximum densities (Dmax) and minimum densities (Dmin) with excellent gradation in a stable manner, and, further, good light fastness.

While the invention has been described in detail and with reference to specific embodiments thereof, it will be apparent to one skilled in the art that various changes and modifications can be made therein without departing from the spirit and scope thereof.

What is claimed is:

1. A method for continuously processing a silver halide color photographic material comprising a support having thereon at least one silver halide emulsion layer with a color developing bath which contains at least one primary aromatic amine color developing agent, wherein (1) at least one compound represented by formula (II) is present in said silver halide emulsion layer in an amount of from 3 to 10 mol % per mol of coupler in the layer in which the compound is added and (2) said silver halide emulsion layer contains silver chlorobromide or silver chloride having a silver iodide content of not more than 0.2 mol %, and said silver halide color photographic material is processed with said color developing bath where the replenishment rate is from 20 ml to 120 ml per square meter of the silver halide color photographic material processed:

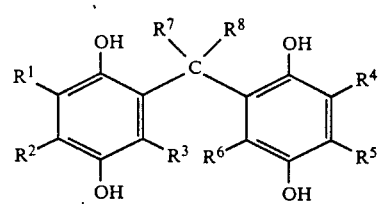

(II)

wherein $R^1$, $R^2$, $R^3$, $R^4$, $R^5$ and $R^6$, which may be the same or different each represents a hydrogen atom, a halogen atom, a sulfo group, a carboxyl group, a cyano group, an alkyl group, an aryl group, an acyl group, an amino group, a sulfonamide group, an alkoxy group, an aryloxy group, an alkylthio group, an arylthio group, an acyl group, an acyloxy group, a carbamoyl group, an alkoxy-carbonyl group or a sulfamoyl group, and $R^1$ and $R^2$, and $R^4$ and $R^5$, may together form a carbocyclic ring or a heterocycle ring; $R^7$ represents a hydrogen atom and $R^8$ represents a methyl group, an ethyl group or an n-propyl group.

2. The method for continuously processing a silver halide color photographic material as claimed in claim 1, wherein said compound represented by formula (I) is contained in the silver halide emulsion layer in an amount of from 3 to 5 mol % per mol of coupler in the layer in which the compound is added.

3. The method for continuously processing a silver halide color photographic material as claimed in claim 1, wherein said silver halide emulsion layer which contains silver chlorobromide or silver chloride has a silver chloride content of from 98 to 100 mol %.

* * * * *